US006094628A

United States Patent [19]

Haber et al.

[11] Patent Number: 6,094,628

[45] Date of Patent: Jul. 25, 2000

[54] METHOD AND APPARATUS FOR TRANSMITTING USER-CUSTOMIZED HIGH-QUALITY, LOW-BIT-RATE SPEECH

[75] Inventors: William Joe Haber, Tempe; George Thomas Kroncke, Gilbert; William George Schmidt, Sun Lakes, all of Ariz.

[73] Assignee: Motorola, Inc., Schaumburg, Ill.

[21] Appl. No.: 09/028,111

[22] Filed: Feb. 23, 1998

[51] Int. Cl.[7] ..... G10L 3/02

[52] U.S. Cl. ..... 704/201; 704/270; 455/558; 379/88.07

[58] Field of Search ..... 704/9, 201, 246, 704/270, 500; 455/557, 558

[56] References Cited

U.S. PATENT DOCUMENTS 5,774,856 6/1999 Haber et al. ..... 704/270

*Primary Examiner*—Dwayne D. Bost
*Assistant Examiner*—Temica M. Davis
*Attorney, Agent, or Firm*—Gregory J. Gorrie

[57] ABSTRACT

A method and apparatus for improving the quality and transmission rates of speech is presented. Upon connection of a call with a receiving terminal, a communication unit (12, 26, 28, 42, 57, 54, 60) reads a dynamic user-specific speech characteristics model (SCM) table and user-specific input stimulus table and sends them to an appropriate point in the connection path with the receiving terminal. As normal voice conversation begins, the user's speech is collected into speech frames. The speech frames are compared to input stimuli entries in the user-specific input stimulus table, and are used to calculate SCMs which are compared to dynamic user-specific SCM table entries in the dynamic user-specific SCM table to generate an encoded bit stream. Simultaneously, speech characteristics statistics are collected and analyzed in view of multiple available generic SCMs to update and improve the dynamic user-specific SCM table during the progress of the call to closely track changes in the user's voice.

16 Claims, 5 Drawing Sheets

METHOD AND APPARATUS FOR TRANSMITTING USER-CUSTOMIZED HIGH-QUALITY, LOW-BIT-RATE SPEECH

FIELD OF THE INVENTION

The present invention relates generally to encoding speech, and more particularly to encoding speech at low bit rates using lookup tables.

BACKGROUND OF THE INVENTION

Vocoders compress and decompress speech data. Their purpose is to reduce the number of bits required for transmission of intelligible digitized speech. Most vocoders include an encoder and a decoder. The encoder characterizes frames of input speech and produces a bitstream for transmission to the decoder. The decoder receives the bitstream and simulates speech from the characterized speech information contained in the bitstream. Simulated speech quality typically decreases as bit rates decrease because less information about the speech is transmitted.

With CELP-type ("Code Excited Linear Prediction") vocoders, the encoder estimates a speaker's speech characteristics, and calculates the approximate pitch. The vocoder also characterizes the "residual" underlying the speech by comparing the residual in the speech frame with a table containing pre-stored residual samples. An index to the closest-fitting residual sample, coefficients describing the speech characteristics, and the pitch are packed into a bitstream and sent to the decoder. The decoder extracts the index, coefficients, and pitch from the bitstream and simulates the frame of speech.

Computational methods employed by prior-art vocoders are typically user independent. These vocoders employ a generic speech characteristic model which contains entries for an extremely broad and expansive set of possible speech characteristics. Accordingly, regardless of who the speaker is, the vocoder uses the same table and executes the same algorithm. In CELP-type vocoders, generic speech characteristic models can be optimized for a particular language, but are not optimized for a particular speaker.

A need exists for a method and apparatus for low bit-rate vocoding which provides higher quality speech. Particularly needed is a user-customized voice coding method and apparatus which allows low-bit rate speech characterization based upon a dynamic underlying speech characteristic model.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

Figure 1:
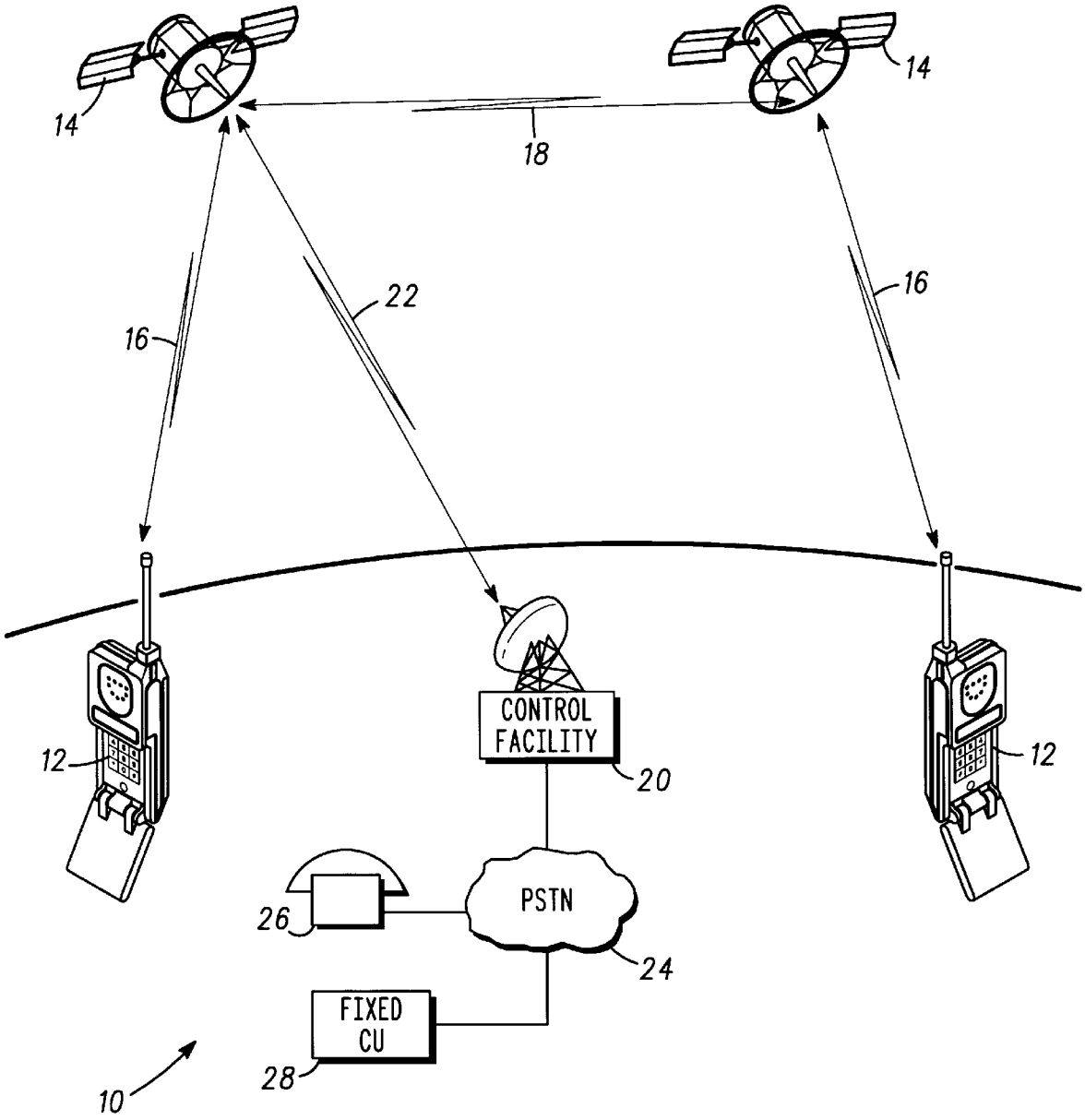
FIG. 1 is a block diagram of a communication system in accordance with the invention.

The exemplification set out herein illustrates a preferred embodiment of the invention in one form thereof, and such exemplification is not intended to be construed as limiting in any manner.

DETAILED DESCRIPTION OF THE DRAWINGS

The method and apparatus of the present invention provide a low bit-rate vocoder which produces high quality transmitted speech. The vocoder of the present invention uses a dynamic user-specific speech characteristics model (SCM) table and a user-specific input stimulus table. The dynamic user-specific SCM is optimized to include entries from an appropriate underlying generic speech characteristics model (SCM) based on the speech patterns and characteristics of the user. As the speech patterns and characteristics of the user change, the dynamic user-specific SCM table is adapted to include user-specific speech patterns and characteristics from the optimal available underlying generic SCMs. The optimal underlying generic SCM chosen provides the most efficient speech encoding within the minimum specified error rates. The ability to update and change the dynamic user-specific SCM table based on different underlying generic SCMs allows more efficient use of memory space, faster sorting time, and fewer bits required to encode a speech pattern for transmission. This results because it allows the dynamic user-specific SCM table to contain only those speech characteristic model entries actually used by the user.

Different generic speech characteristic models exist which contain different generic speech characteristics for a particular type of speaker. For example, different generic speech characteristics models typically exist for a male voice and for a female voice. The speech characteristics of a given user will typically fall into one or the other of the generic male SCM or generic female SCM. Additionally, generic SCMs optimized for a particular language also exist, and including subsets for male and female voices. The optimal underlying generic SCM, from which the dynamic user-specific SCM table entries are derived, is typically the generic SCM which was developed for speakers having similar characteristics as the user. Even these subsets of generic SCMs, however, include a vast number of speech characteristics model entries which are never used by any one speaker. Accordingly, a dynamic user-specific SCM table is built by choosing an optimal generic SCM which most closely matches the speech characteristics of the user, and then extracting a subset of the optimal generic SCM including only those optimal generic SCM entries that the user actually uses. Furthermore, the dynamic user-specific SCM table is updated during the call such that if the user's voice has changed slightly, as for example when the user has a cold, the table is updated in realtime to more accurately represent the user's voice. Standardized models published by the ITU include Recommendation G.728 (coding of speech at 16 Kbits/sec using low-delay code-excited linear prediction methods) and Recommendation G.279 (coding of speech at 8 Kbits/sec using conjugate structure algebraic-code-excited linear prediction methods).

The dynamic user-specific SCM table and input stimulus table, along with various generic speech characteristics models, are stored within a communication unit (CU) or in an external storage device (e.g., a User Information Card (SIM card) or a control facility memory device). As used herein, a "transmit vocoder" is a vocoder that is encoding speech samples and a "receive vocoder" is a vocoder that is decoding the speech. The transmit vocoder or the receive vocoder can be located within a CU or in a control facility that provides service to telephones which do not have vocoder equipment.

During call setup, the dynamic user-specific SCM table and input stimulus table for the transmit vocoder user are sent to the receive vocoder to be used in the decoding process. During the call, the speech from the transmit vocoder user is characterized by determining table entries which most closely match the user's speech. Information describing these table entries is sent to the receive vocoder. As the call progresses, information and statistics of the user's speech characteristics are collected and compared to the current information in the dynamic user-specific SCM. If the statistics and information are different enough to warrant updating the dynamic user-specific SCM table, the dynamic user-specific SCM table is updated on the user's CU, and changes to the user-specific SCM table are sent to the remote CU which updates its copy of the user's dynamic user-specific SCM table. Accordingly, changes in the user's speech characteristics are updated in realtime as the call progresses. Because the method and apparatus utilize user customized tables, speech quality is enhanced and the same quality is achieved throughout the call even when the user's voice changes. In addition, the use of tables allows the characterized speech to be transmitted at a low bit rate. Although the method and apparatus of the present invention are described using dynamic user-specific SCM tables and input stimulus tables, other user-customized tables used to characterize speech are encompassed within the scope of the description and claims.

FIG. 1 illustrates communication system 10 in accordance with a preferred embodiment of the invention. Communication system 10 includes Mobile Communication Units 12 (MCUs), satellites 14, Control Facility 20 (CF), Public Switched Telephone Network 24 (PSTN), conventional telephone 26, and Fixed Communications Unit 28 (FCU). As used herein, where both MCUs 12 and FCUs 28 perform the same functions, the general term Communication Unit (CU) will be used.

MCUs 12 can be, for example, cellular telephones or radios adapted to communicate with satellites 14 over radio-frequency (RF) links 16. FCUs 28 can be telephone units linked directly with PSTN 24 which have attached or portable handsets. Unlike conventional telephone 26, CUs 12, 28 include vocoder devices for compressing speech data. In a preferred embodiment, CUs 12, 28 also include a User Information Card (SIM card) interface. This interface allows a CU user to swipe or insert a SIM card containing information unique to the user. A SIM card can be, for example, a magnetic strip card. The SIM card preferably contains one or more user identification numbers, one or more generic SCMs, and one or more dynamic user-specific SCM tables and input stimulus tables which are loaded into the vocoding process. By using a SIM card, a user can load his or her vocoding information into any CU. CUs, 12, 28 are described in more detail in conjunction with FIG. 3.

Satellites 14 can be low-earth, medium-earth, or geostationary satellites. In a preferred embodiment, satellites 14 are low-earth orbit satellites which communicate with each other over link 18. Thus, a call from a first CU 12, 28 that is serviced by a first satellite 14 can be routed directly through one or more satellites over links 18 to a second CU 12, 28 serviced by a second satellite 14. In an alternate embodiment, satellites 14 may be part of a "bent pipe" system. Satellites 14 route data packets received from CUs 12, 28, CFs 20, and other communication devices (not shown). Satellites 14 comnunicate with CF 20 over link 22.

CF 20 is a device which provides an interface between satellites 14 and a terrestrial telephony apparatus, such as PSTN 24, which provides telephone service to conventional telephone 26 and FCU 28. In a preferred embodiment, CF 20 includes a vocoder which enables CF 20 to decode encoded speech signals before sending the speech signals through PSTN 24 to conventional telephone 26. Because FCU 28 includes its own vocoder, the vocoder located within CF 20 does not need to decode the encoded speech signals destined for FCU 28. CF 20 is described in more detail in conjunction with FIG. 4.

As described above, in a preferred embodiment, generic SCMs and a user's dynamic user-specific SCM table and input stimulus table are stored on a SIM card. In an alternate embodiment, the generic SCMs, dynamic user-specific SCM table and input stimulus table are stored in a CU memory device. In another alternate embodiment, CF 20 includes a memory device in which generic SCMS, dynamic user-specific SCM tables, and input stimulus tables are stored for registered users. The dynamic user-specific SCM table is initially developed during a training mode at registration of a user of a new account, and is derived from one of the available speech characteristics models, preferably the one which generates the most efficient encoding while maintaining an error rate within the system's specified minimum requirements. During call setup, a CF that has the registered user's tables in storage sends the dynamic user-specific SCM table and input stimulus table to both the transmit vocoder and the receive vocoder. Subsequently, during the call itself, the dynamic user-specific SCM table is continuously updated as the user's speech characteristics change. This allows variations in the user's voice to be reflected accurately when reproduced by the receiving end of the call. At termination of the call, the dynamic user-specific SCM table stored on the SIM card, in CU memory, or in CF memory can be updated with the changes contained in the updated user-specific SCM table.

FIG. 1 illustrates only a few CUs 12, 28, satellites 14, CF 20, PSTN 24, and telephone 26 for clarity in illustration. However, any number of CUs 12, 28, satellites 14, CF 20, PSTNs 24, and telephones 26 may be used in a communication system.

Figure 2:
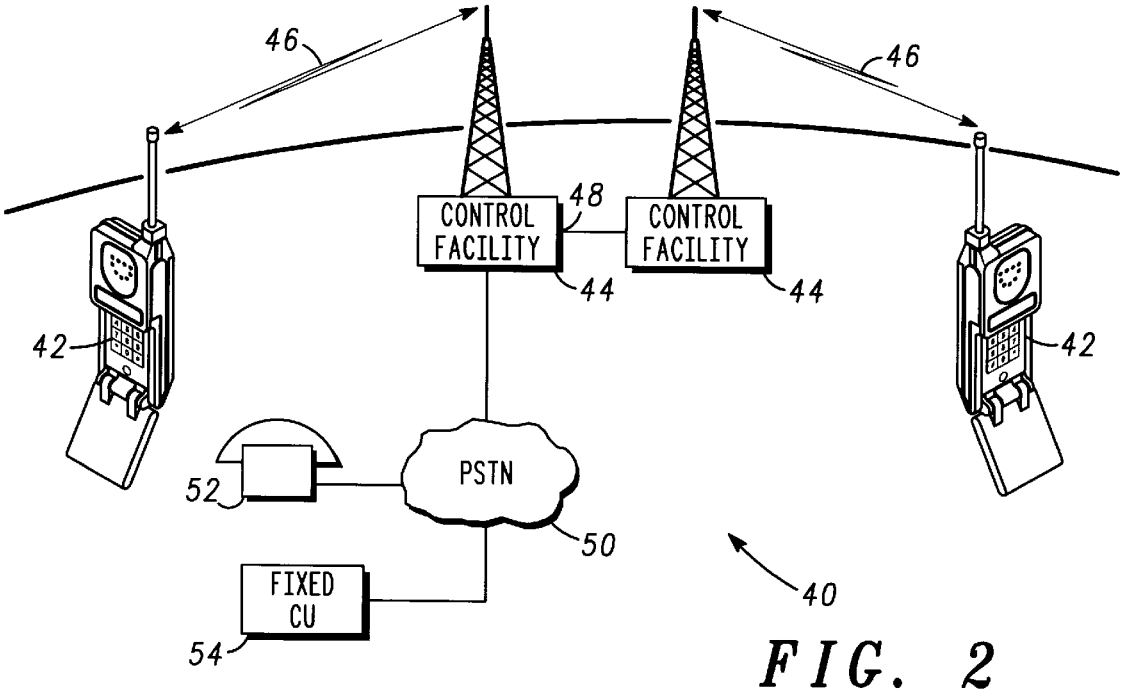
FIG. 2 is a block diagram of an alternative embodiment of a communication system in accordance with the invention.

FIG. 2 illustrates communication system 40 in accordance with an alternate embodiment of the present invention. Communication system 40 includes MCUs 42, CFs 44, PSTN 50, conventional telephone 52, and FCU 54. MCUs 42 can be, for example, cellular telephones or radios adapted to communicate with CFs 44 over RF links 46. CUs 42, 54 include a vocoder device for compressing speech data. In a preferred embodiment, CUs 42, 54 also include a SIM card Interface.

CF 44 is a device which provides an interface between MCUs 42 and a terrestrial telephony apparatus, such as PSTN 50 which provides telephone service to conventional telephone 52 and FCU 54. In addition, CF 44 can perform call setup functions, and other system control functions. In a preferred embodiment CF 44 includes a vocoder which enables CF 44 to decode encoded speech signals before sending the speech signals through PSTN 50 to conventional telephone 52. Because FCU 54 includes its own vocoder, the vocoder located within CF 44 does not need to decode the encoded speech signals destined for FCU 54.

Multiple CFs 44 can be linked together using link 48 which may be an RF or hard-wired link. Link 48 enables CUs 42, 54 in different arms to communicate with each other. A representative CF used as CF 44 is described in more detail in conjunction with FIG. 4.

FIG. 2 illustrates only a few CUs 42,54, CFs 44, PSTNs 50, and telephones 52 for clarity of illustration. However, any number of CUs 42, 54, CFs 44, PSTNs 50, and telephones 52 may be used in a communication system.

In an alternate embodiment, the system of FIG. 1 and FIG. 2 can be networked together to allow communication between terrestrial and RF communication systems.

Figure 3:
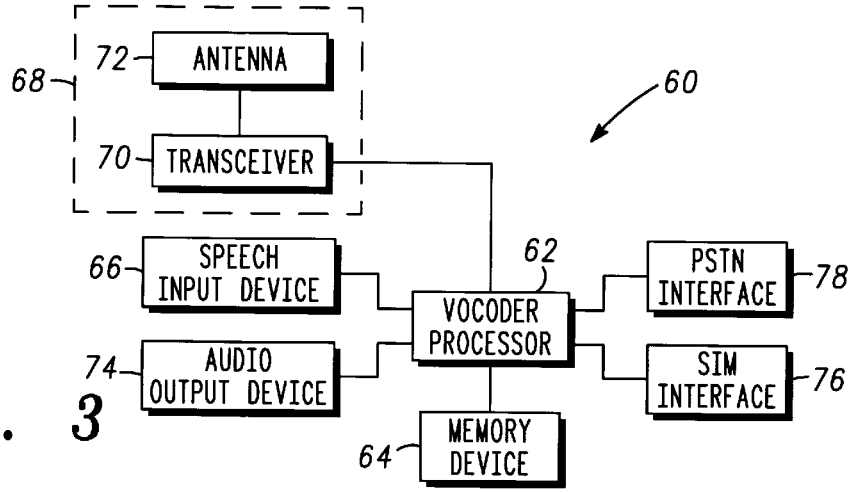
FIG. 3 is a block diagram of a communication unit in accordance with the invention.

FIG. 3 illustrates a communication unit CU 60 in accordance with a preferred embodiment of the present invention. CU 60 may be used as an MCU such as MCU 12 of FIG. 1 or as an FCU such as FCU 28 of FIG. 1. CU 60 includes vocoder processor 62, memory device 64, speech input device 66, and audio output device 74. Memory device 64 is used to store dynamic user-specific SCM tables and input stimulus tables for use by vocoder processor 62. Speech input device 66 is used to collect speech samples from the user of CU 60. Speech samples are encoded by vocoder processor 62 during a call, and also are used to generate the dynamic user-specific SCM table and input stimulus tables during a training procedure. Audio output device 74 is used to output decoded speech.

In a preferred embodiment, CU 60 also includes SIM card interface 76. As described previously, a user can insert or swipe a SIM card through SIM card interface 76, enabling the user's unique dynamic user-specific SCM table and input stimulus table to be loaded into memory device 64. In alternate embodiments, the generic SCMs, user's unique dynamic user-specific SCM table and input stimulus table are pre-stored in memory device 64 or in a CF (e.g., CF 20, FIG. 1).

When CU 60 is an FCU, CU 60 further includes PSTN interface 78 which enables CU 60 to communicate with a PSTN (e.g., PSTN 24, FIG. 1). When CU 60 is an MCU, CU 60 further includes RF interface unit 68. RF interface unit 69 includes transceiver 70 and antenna 72, which enable CU 60 to communicate over an RF link (e.g., to satellite 14, FIG. 1). When a CU is capable of functioning as both an FCU and an MCU, the CU includes both PSTN interface 78 and RF interface 68.

Figure 4:
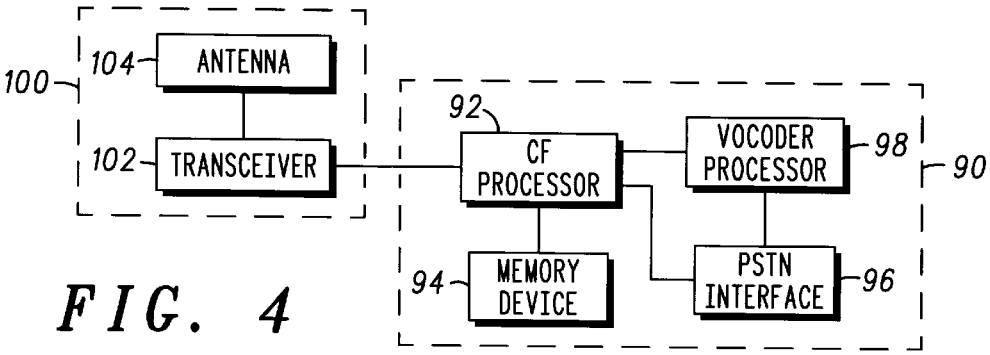
FIG. 4 is a block diagram of a control facility in accordance with the invention.

FIG. 4 illustrates a control function CF 90 which is used as CF 20 of FIG. 1 or CF 44 of FIG. 2 in accordance with a preferred embodiment of the present invention. CF 90 includes CF processor 92, memory device 94, PSTN interface 96, and vocoder processor 98. CF processor 92 performs the functions of call setup and telemetry, tracking, and control. Memory device 94 is used to store information needed by CF processor 92. In an alternate embodiment, memory device 94 contains generic SCMs, dynamic user-specific SCM tables and input stimulus tables for registered users. When a call with a registered user is being set up, CF processor 92 sends the dynamic user-specific SCM tables and the input stimulus tables to the transmit CU and receive CU.

Vocoder processor 98 is used to encode and decode speech when a conventional telephone (e.g., telephone 26, FIG. 1) is a party to a call with a CU. When a call between a CU and an FCU (e.g., FCU 28. FIG. 1) is being supported, vocoder processor 98 can be bypassed as shown in FIG. 4. PSTN interface 96 allows CF processor 92 and vocoder processor 98 to communicate with a PSTN (e.g., PSTN 24. FIG. 1).

CF 90 is connected to RF interface 100 by a hard-wired, RF, or optical link. RF interface 100 includes transceiver 102 and antenna 104 which enable CF 20 to communicate with satellites (eg., satellites 14, FIG. 1) or MCUs (e.g., MCUs 42, MG. 2), RF interface 100 can be co-located with CF 90, or can be remote from CF 90.

Figure 5:
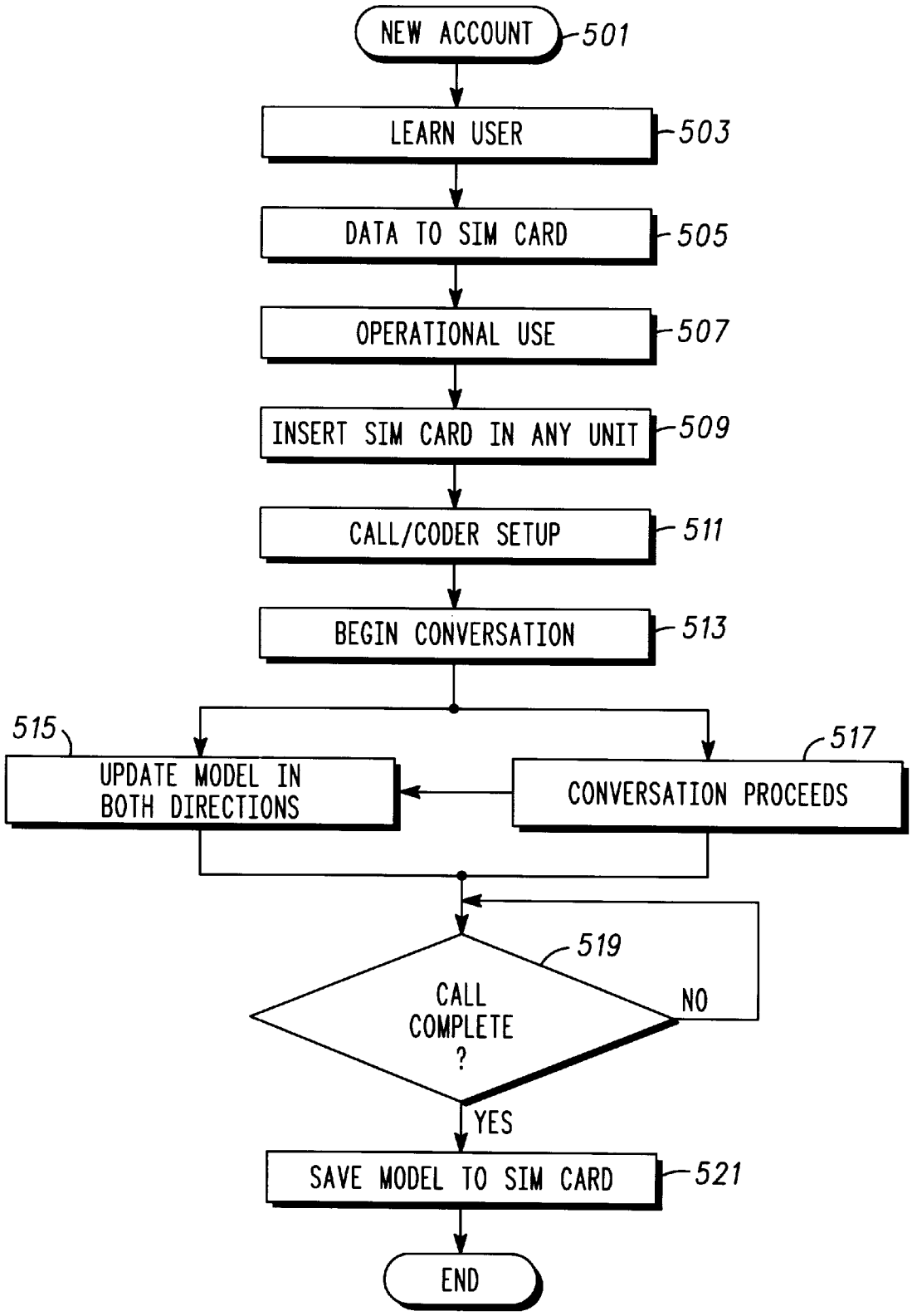
FIG. 5 is a flow diagram of a method of operation of the invention.

FIG. 5 is a flow diagram of an operational system in accordance with the principles of the invention. The flow diagram assumes in step 501 that the user is setting up a new account (e.g., when the user buys a new phone or registers a different person to the phone).

In step 503, the phone enters training mode to learn the user's voice and speech patterns. In one embodiment, the training task is performed by the CU. In alternate embodiments the training task can be performed by other devices (e.g., a CF). During the training task, speech data is collected from the user and an dynamic user-specific SCM table and an input stimulus table am created for that user. The dynamic user-specific SCM table and input stimulus table can be generated in a compressed or uncompressed form. The user is also given a user identification ID number.

The training task is either performed before a call attempt is made, or is performed during vocoder initialization. The training task is performed, for example, when the user executes a series of keypresses to reach the training mode. These keypresses can be accompanied by display messages from the CU designed to lead the user through the training mode.

In one embodiment, the CU prompts the user to speak. For example, the user can be requested to repeat a predetermined sequence of statements. The statements can be designed to cover a broad range of sounds. Alternatively, the user can be requested to say anything that the user wishes. As the user speaks, a frame of speech data is collected. A frame of speech data is desirably a predetermined amount of speech (e.g., 30 msec) in the form of digital samples. The digital samples are collected by a speech input device (e.g., speech input device 66, FIG. 3) which includes an analog-to-digital converter that converts the analog speech waveform into the sequence of digital samples.

After a frame of speech is collected, an SCM entry from an optimal generic SCM for the speech frame is determined. The optimal generic SCM for the speech frame is preferably the generic SCM available which most closely matches the speech characteristics of the user over the majority of collected speech frames. The SCM entry is a representation of the characteristics of the speech frame.

Methods of determining optimal speech characteristics models and matching entries are well known to those of skill in the art. The SCM entry is added to the user's dynamic user-specific SCM table. The dynamic user-specific SCM table contains a list of optimal generic SCM entries obtained from the user's speech frames. Each of the dynamic user-specific SCM table entries represent different characteristics of the user's speech. The size of the dynamic user-specific SCM table is somewhat arbitrary. The table should be large enough to provide a representative range of dynamic user-specific SCMs, but should be small enough that the time required to search the dynamic user-specific SCM table is not unacceptably long.

In a preferred embodiment, each dynamic user-specific SCM table entry has an associated counter which represents the number of times the same or a substantially similar dynamic user-specific SCM entry has occurred during the training task. Each new dynamic user-specific SCM entry is analyzed to determine whether it is substantially similar to a dynamic user-specific SCM table entry already in the dynamic user-specific SCM table. When the new dynamic user-specific SCM is substantially similar to an existing dynamic user-specific SCM, the counter is incremented. Thus, the counter represents the frequency of each dynamic user-specific SCM table entry. In a preferred embodiment, this information is used later in when sorting the dynamic user-specific SCM table and in encoding collected speech frames.

During training mode, collected speech frames are added to the input stimulus table. The input stimulus table contains a list of input stimulus from the user. The input stimulus can be raw or filtered speech data. Similar to the dynamic user-specific SCM table, the size of the input stimulus table is arbitrary. In a preferred embodiment, a counter is also associated with each input stimulus table entry to indicate the frequency of substantially similar input stimuli occurring.

At the completion of the training task, the dynamic user-specific SCM table entries and the input stimulus table entries are sorted, preferably by frequency of occurrence. As indicated by the dynamic user-specific SCM and input stimulus counters associated with each entry, the more frequently occurring table entries will be placed higher in the respective tables. In an alternate embodiment, the dynamic user-specific SCM table entries and input stimulus table entries are left in an order that does not indicate the frequency of occurrence.

In a preferred embodiment, the input stimulus table entries and dynamic user-specific SCM table entries are then preferably assigned transmission codes. For example, using the well-known Huffman compression technique, the frequency statistics can be used to develop a set of transmission codewords for the input stimuli entries and dynamic user-specific SCM entries, where the most frequently used stimuli and dynamic user-specific SCM table entries are the shortest transmission codeword. The purpose of encoding the input stimulus table entries is to minimize the number of bits that need to be sent to the receive vocoder during the update task.

In step 505, the dynamic user-specific SCM table, input stimulus table, and user ID are stored on the user's SIM card. In a preferred embodiment, they are stored on the user's SIM card. Storing the information on the SIM card allows rapid access to the information without using the CU's memory storage space. The user can remove the SIM card from the CU and carry the SIM card just as one would carry a credit card. The SIM card can also contain other information the user needs to use a CU. In an alternate embodiment, the information can be stored in the CU's memory storage device (e.g., memory device 64, FIG. 3). In another alternate embodiment, the CU can send the dynamic user-specific SCM table and the input stimulus table through the communication system to a control facility (e.g., CF 20, FIG. 1). When the tables are needed (i.e., during vocoder initialization), they are sent to the transmit vocoder and the receive vocoder. Information for one or more users can be stored on a SIM card, in the CU, or at the CF.

Accordingly, during the training steps 501–505, a generic SCM is chosen as the underlying generic SCM and pared down to a more compact table, namely the dynamic user-specific SCM table, which allows the same quality voice to be transmitted using fewer bits. During training mode the phone learns the user's speech patterns and impediments. Moreover, the phone evaluates the user's speech patterns and impediments in light of one or more generic SCMs, chooses the generic SCM which contains the closest match to the user's speech, develops a set of user-specific input stimuli and enters them into a user specific input stimuli table, extracts those model entries from the chosen generic SCM that are actually used by the user during speech into a dynamic user-specific SCM table, correlates the input stimuli table entries with the dynamic user-specific SCM table entries, sorts the dynamic user-specific SCM table and input stimuli table preferably in order of frequency of use, and assigns a transmission code to each dynamic user-specific SCM table entry. Preferably the transmission code is shortest in length for the most frequently used speech and longest for the least frequently used speech. A suitable sorting algorithm for this approach is the well-known Huffman coding algorithm.

In step 507, the user operates the phone. The user inserts the SIM card into a CU 12, 28, 42, 54 in step 509.

The SIM card contains the dynamic user-specific SCM table and input stimuli, and preferably a number of different generic SCMS. The call is set up in step 511 by dialing the destination number and exchanging dynamic user-specific SCM tables and input stimuli tables. This allows each phone to encode speech according to the user's specific speech configuration parameters, and also to decode speech encoded using the user's specific configuration parameters.

Conversation then begins in step 513.

In step 517, the transmitting CU encodes and transmits speech data according to the dynamic user-specific SCM table, while the receiving CU then decodes the encoded speech using the transmitting CU's dynamic user-specific SCM table. When the transmitting CU receives speech input from the user, a speech frame is collected and compared with entries from the user's user-specific input stimulus table. In one embodiment, a least squares error measurement between the speech frame and each input stimulus table entry can yield error values that indicate how close a fit each input stimulus table entry is to the speech frame. Other comparison techniques can also be applied. Preferably, the input stimulus table entries are stored in a compressed form. The speech frame and the input stimulus table entries should be compared when both are in a compressed or an uncompressed form. When the input stimulus table entries have been previously sorted (e.g., using the Huffman coding technique), the entire table need not be searched to find a table entry that is sufficiently close to the speech frame. Table entries need only be evaluated until the comparison yields an error that is within an acceptable limit. The CU then preferably stores the index to the closest input stimulus table entry.

Next, an SCM is calculated for the speech frame. The SCM can be calculated by using vocoder techniques common to those of skill in the art. Where multiple generic SCMs exist, an SCM is calculated for the speech frame using each generic SCM. The calculated SCM which generates the most efficient encoding while meeting a minimum specified error rate is preferably chosen as the returned calculated SCM. The calculated SCM is then compared with the user's dynamic user-specific SCM table entries. The comparison can be, for example, a determination of the least squares error between the calculated SCM and each dynamic user-specific SCM table entry. The most closely matched dynamic user-specific SCM table entry is determined. The closest dynamic user-specific SCM table entry is the entry having the smallest error. When the dynamic user-specific SCM table entries have been previously sorted (e.g., using the Huffman compression technique), the entire table need not be searched to find a table entry that is sufficiently close to the calculated SCM. Table entries need only be evaluated until the comparison yields an error that is within an acceptable limit. The CU then desirably stores the index to the closest dynamic user-specific SCM table entry. A bitstream is then generated by the transceiver. In a preferred embodiment the bitstream contains the closest dynamic user-specific SCM index and the closest input stimulus index. Typically, the bitstream also includes error control bits to achieve a required bit error ratio for the channel. Once the bitstream is generated, it is transmitted to the receiving CU via an antenna.

The receiving CU decodes the transmitted bitstream using the user's dynamic user-specific SCM table and input stimulus table that were previously sent to the receiving CU during call setup. When the receiving CU receives the transmitted bitstream from the transmitting CU, the dynamic user-specific SCM index is extracted from the bitstream. This index is used to look up the dynamic user-specific SCM table entry in the user's dynamic user-specific SCM table.

The input stimulus information is also extracted from the bitstream. This index is used to look up the input stimulus table entry in the user's user-specific input stimuli table that was sent to the receiving CU during call setup. The vocoder processor then excites the uncampressed version of the dynamic user-specific SCM table entry, which models the transmitting user's speech characteristics for this speech frame, is excited with the input stimulus table entry. This produces a frame of simulated speech which is output to an audio output device.

Accordingly, the transmitting CU sends encoded speech data and the receiving CU decodes it to generate speech that sounds like the transmitting CU's user, while using fewer transmitted bits. As the call progresses, the dynamic user-specific SCM table is continuously updated, as shown in step 515. This is useful, for example, when the transmitting user has a cold. The transmitting CU preferably operates to fine tune the dynamic user-specific SCM table during the course of the conversation. This fine tuning can include finding a more optimal underlying generic SCM from the available generic SCMs which matches the changing speech characteristics of the user, and adding, modifying, and deleting entries from the copies of the dynamic user-specific SCM table used by both the transmitting CU and the receiving CU. The determination of whether a change should be made to the dynamic user-specific SCM table is preferably determined by comparing the calculated SCM of the speech frame with the dynamic user-specific SCM table entries. When the calculated SCM is substantially the same as any entry, the entry's counter is incremented and the dynamic user-specific SCM table is restored if necessary. When the calculated SCM is not substantially the same as any entry, the calculated SCM can replace a dynamic user-specific SCM table entry having a low incidence of occurrence. The input stimulus table is preferably updated in a similar fashion. Updates to the receiving CU's copy of the dynamic user-specific SCM are preferably accomplished by sending table updates to the receiving CU as part of the bitstream for the speech frame that is generated and sent to the receiving CU, or during gaps in the conversation. Table updates are thus performed during the call as the user's speech characteristics change. Step 515 is shown as a branch in the flow chart to indicate that this feature can be implemented to be switched on or off as the user desires by a switch, a button on the phone, or by programming a sequence of numbers via the keyboard on the phone.

When the call ends in step 519, the dynamic user-specific SCM table and input stimuli table can be saved to the SIM card, CU memory, or CF memory as shown in step 521.

Alternatively, the CU can be configured to maintain the original dynamic user-specific SCM table and input stimuli table. One reason for maintaining the original tables occurs in the situation where the registered user allows a new user to use the CU. If an unregistered user speaks into a CU that is registered to a registered user, the quality of speech is likely to be low initially. As the unregistered user speaks, the CU updates the dynamic user-specific SCM table to match the unregistered user's voice, as shown in step 515, or alternatively can be configured to maintain the initial registered user's dynamic user-specific SCM and input stimuli tables by not storing the updated tables upon termination of the call (i.e., by not performing step 521). The determination of whether or not to update the user-specific tables upon termination of the call can be switchably configurable.

Figure 6:
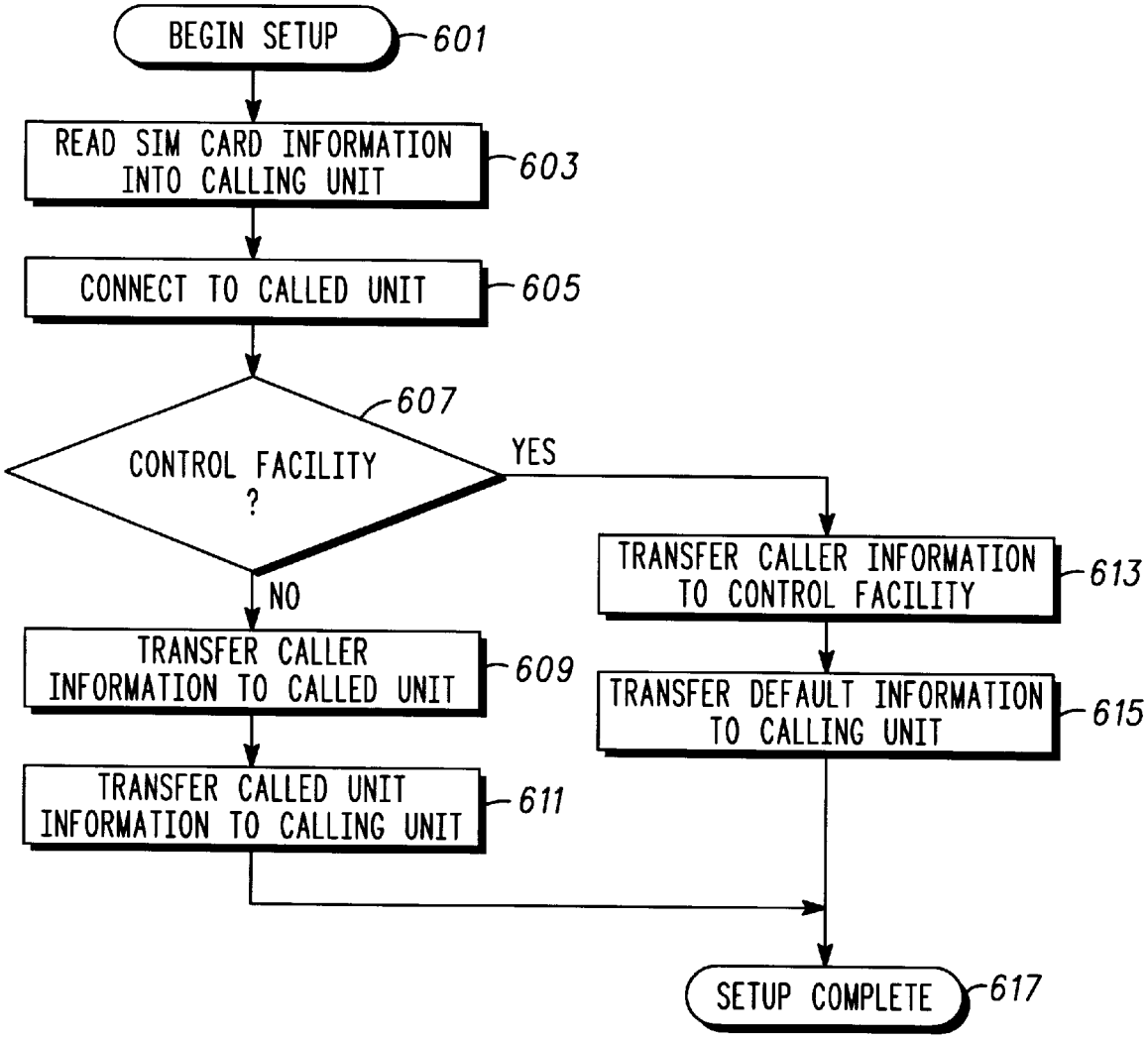
FIG. 6 is a flow diagram illustrating a procedure for setting up a call in accordance with the invention.

FIG. 6 is a flow diagram illustrating a procedure for setting up a call (see step 511 in FIG. 5). In step 601, a user initiates a call. In step 603, the transmitting CU reads information from the inserted SIM card, including the dynamic user-specific SCM table and input stimuli unique to the user. The receiving CU answers the transmitting CU in step 605. In step 607, the transmitting CU determines whether it is connecting through a control facility to connect to a public switched telephone network (PSTN). This step is necessary because the setup is slightly different between the two types of connections. If it is not a control facility, then the receiving CU is another cellular phone, so a cellular-phone-to-cellular-phone connection must be made. Accordingly, in step 609 the dynamic user-specific SCM table and input stimuli table are transferred from the transmitting CU to the receiving CU to allow the receiving CU to be able to decode the transmitted speech that is encoded by the transmitting CU. Likewise, in step 611 the receiving CU's dynamic user-specific SCM table and input stimuli table are transferred from the receiving CU to the transmitting CU so that the transmitting CU can decode speech sent to it by the receiving CU. If the call is connecting through a control facility, then the receiving CU is connected through a PSTN. In this case, all of the speech decoding must be performed at the control facility since conventional telephones do not have this capability. Accordingly, in step 613, the dynamic user-specific SCM table and input stimuli table is transferred from the transmitting CU to the control facility, where it is stored and used to decode speech received from the transmitting CU before sending the speech on to the receiving CU over the PSTN. In addition, in step 615 a default SCM model is transferred to the control facility for use in encoding speech received from the receiving CU before transferring the speech to the transmitting CU. In the alternative, the control facility itself could comprise one or more generic SCM models and training means for optimizing the receiving party's speech encoding as the call progresses.

Figure 7:
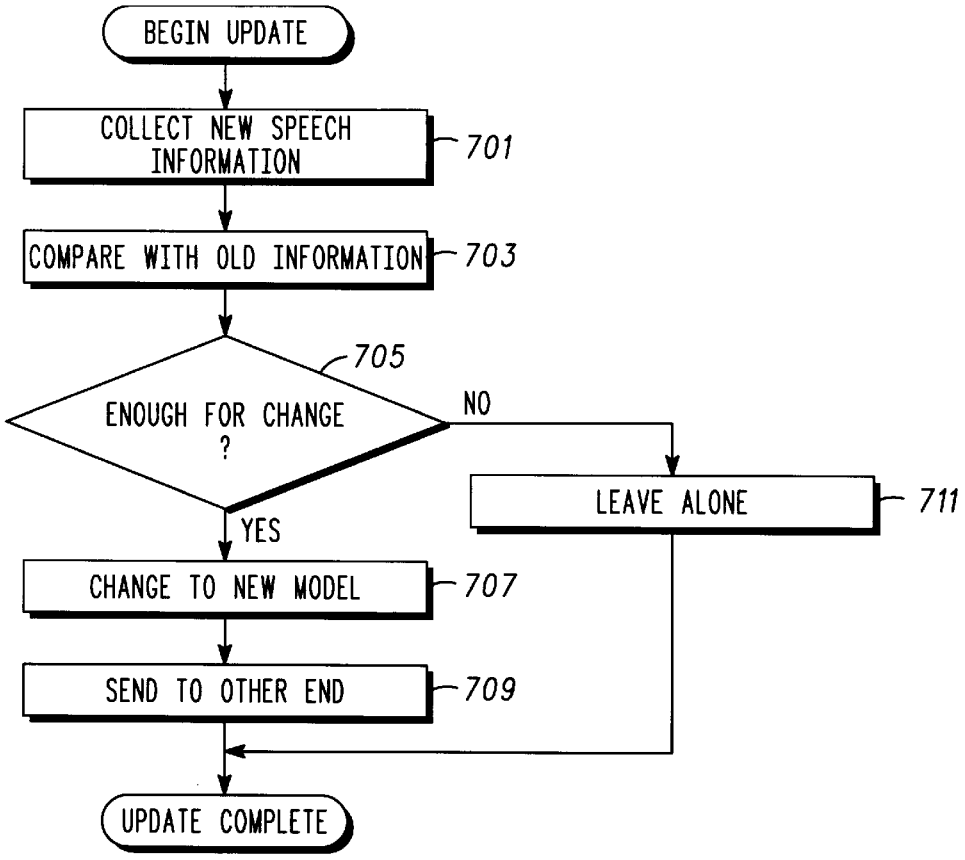
FIG. 7 is a flow diagram illustrating a process for updating a dynamic user-specific SCM table in accordance with the invention.

FIG. 7 is a flow diagram illustrating a process for updating the dynamic user-specific SCM table in accordance with the invention. The dynamic user-specific SCM table can be updated during setup of a new account, during an initialization process, and dynamically during a conversation while a call is in progress. The phone can include a switch or button which is set to one mode to store updates of the dynamic user-specific SCM table, or can be programmed to do so by pressing a combination of buttons, or can be set to automatically store updates. In step 701, the transmitting CU collects new speech information. The new speech information is compared to the old speech information contained in the dynamic user-specific SCM and input stimuli tables, if they exist, in step 703. A determination is made as to whether the differences between the new and old speech information meet a minimum change threshold in step 705. If the differences do not meet the minimum change threshold, the tables are not updated, as shown in step 711. If the differences do meet the minimum change threshold, the changes are updated in the transmitting CU's copy of the dynamic user-specific CU in step 707, and are sent to the receiving CU in step 709 for updating the receiving CU's copy of the dynamic user-specific CU. Preferably this is accomplished by sending only the changes to the tables. Once the updates are complete, the process is preferably repeated continuously during the call.

Figure 8:
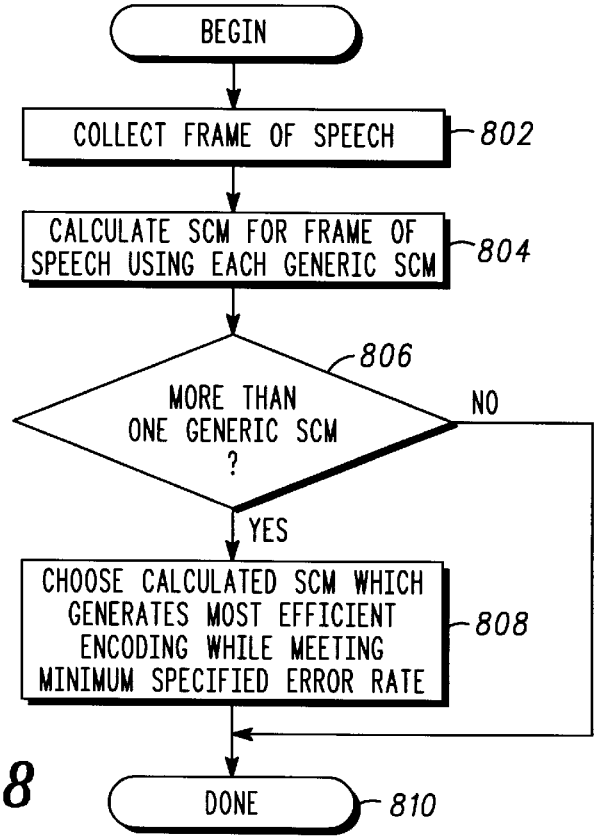
FIG. 8 is a flow diagram illustrating a procedure for calculating an SCM.

Preferably, transmitting CUs have access to more than one generic SCM, each of which being tailored to a different type of speaker. When multiple generic SCMs are available for use by the transmitting CU, a determination must be made of which model to use when calculating an SCM for a speech frame and for updating the dynamic user-specific SCM table. FIG. 8 is a flow diagram illustrating one embodiment for determining a calculated SCM for a speech frame. A speech frame is collected in step 802. An SCM is calculated for the speech frame using each available generic SCM in step 804. In step 806 a determination is made as to whether more than one generic SCMs exist. If more than one generic SCM exists, the multiple calculated SCMs are compared and the calculated SCM which generates the most efficient encoding while meeting a minimum specified error rate is preferably chosen in step 808. The calculated SCM, or chosen calculated SCM if more than one generic SCM exists, is returned as the calculated SCM in step 810.

One embodiment of the above-described method and apparatus for transmitting high-quality low-bit-rate speech employs a SIM card which stores the dynamic user-specific SCM table and user-specific input stimuli tables. It will be appreciated by those skilled in the art that dynamic user-specific SCM tables and input stimulus tables for more than one user can be stored on a single SIM card. Furthermore, information for multiple users can be stored in a CU memory device. In another alternate embodiment multiple user information could be stored in a CF memory device. One method for operating with multiple users' information stored is to include user ID information for each user. One embodiment for determining the current user's user ID information is to require the user to enter a passcode on the keypad of the communication unit. Alternatively, the communication unit could contain signal processing means to determine the user's user ID information based on the speech characteristics of the current user's voice.

The method and apparatus for transmitting high-quality low-bit-rate speech described herein provides many significant improvements over the prior art. First, by employing a dynamic user-specific SCM table which is unique to the user, speaker recognition and resolution is greatly improved, and background and quantization noise is reduced. Additionally, the use of a user-specific input stimuli table adds another layer of quality and speaker recognition to the speech signal at the receiver's terminal. Moreover, the user-specific input stimuli table operates as a statistically-derived "dictionary" of the user's most frequently used input stimuli, further compressed in codeword output by use of Huffman coding, or any other similar compression algorithm, and permits the input stimuli to be transmitted with the lowest possible overall bit rate.

What is claimed is:

1. A method for transmitting high-quality low-bit-rate speech, comprising:

(a) establishing a communications connection with a receiving device;

(b) reading a user-specific speech characteristics model (SCM) table and a user-specific input stimuli table;

(c) sending said user-specific SCM table and said user-specific input stimuli table to said receiving device, said receiving device maintaining a copy of said user-specific SCM table and said user-specific input stimuli table;

(d) receiving speech input from a user;

matching said speech input with an input stimuli table entry from said user-specific input stimuli table;

(e) determining a codeword for an SCM entry from said dynamic user-specific SCM table, said SCM entry being mapped to said input stimuli table entry;

(f) transmitting said codeword to said receiving device;

(g) reading a plurality of generic speech characteristics models (SCMs);

(h) calculating a plurality of calculated SCMs, each calculated based on a different one of said plurality of generic SCMs;

(i) choosing a chosen calculated SCM from among said calculated SCMs which produces efficient encoding and meets minimum error rate requirements;

(j) processing said chosen calculated SCM to determine whether to update said dynamic user-specific SCM table and or said user-specific input stimuli table with changes;

(k) updating said dynamic user-specific SCM table and or said user-specific input stimuli table with said changes if it is determined that said changes are proper; and (l) sending said changes to said receiving device, said receiving device updating said copy of said user-specific SCM table and said user-specific input stimuli table with said changes.

2. A method in accordance with claim 1, comprising:

reading said user-specific SCM table and said user-specific input stimuli table from a user information card (SIM card) upon which said user-specific SCM table and said user-specific input stimuli table are stored.

3. A method in accordance with claim 1, wherein:

said processing step comprises:

processing said speech input to generate new speech characteristics statistics;

comparing said new speech characteristics statistics with old speech characteristics statistics generated from said user-specific SCM table to determine any differences between said new speech characteristics statistics and said old speech characteristics statistics;

determining whether said differences are significant enough to require updating said user-specific SCM table and or said user-specific input stimuli table;

providing an indication if said changes should be updated to said user-specific SCM table and or said user-specific input stimuli table.

4. A method in accordance with claim 3, wherein:

said step for processing said speech input to generate new speech characteristics statistics comprises:

matching said speech input to a closest matching entry in each of one or more generic speech characteristic models (SCMs) comprising a plurality of generic SCM entries, said plurality of generic SCM entries covering a range of different speech characteristics of a plurality of different speakers;

determining which closest matching entry generates a most efficient encoding while meeting a minimum error rate specification;

including said closest matching entry in said new speech characteristics.

5. A communication unit operable for communicating in a telecommunications system, comprising:

means for reading a generic speech characteristics model (SCM) comprising a plurality of generic SCM entries, said plurality of generic SCM entries covering a range of different speech characteristics of a plurality of different speakers;

means for accessing a dynamic user-specific speech cavity model (SCM) table comprising a plurality of user-specific SCM table entries each comprising one of said generic SCM entries which model a speech characteristic employed by a user of said communication unit;

means for accessing a user-specific input stimuli table comprising a plurality of input stimuli entries each comprising a speech frame representing a speech pattern employed by said user and each mapping to a user-specific SCM table entry in said dynamic user-specific SCM table;

a transceiver operable to transmit and receive signals;

speech input means operable to receive an input speech pattern frcm said user;

a vocoder processor operable to convert said input speech pattern to an input speech frame;

control means operable to send said user-specific input stimuli table and said user-specific input stimuli table to a receiving communications unit during a call setup, and to decode said input speech frame, match said decoded input speech frame to a matching input stimuli table entry in said input stimuli table, calculate a calculated SCM for said speech frame using at least two of said generic SCMs, determine which of said calculated SCMs generates a most efficient encoding while maintaining a minimum error rate, match said most efficient calculated SCM to a matching user-specific SCM table entry in said dynamic user-specific SCM table, encode said matching user-specific SCM table entry to a pre-determined compressed code, process new speech pattern information based on said input speech frame and said most efficient calculated SCM, compare said new speech pattern information with old speech pattern information, determine if table updates need to be made to said dynamic user-specific SCM table and or said user-specific input stimuli table, and to send said compressed code, and said table updates if it is determined that said table updates need to be made, to said transceiver for transmission.

6. A communication unit in accordance with claim 5, comprising:

audio output means for converting digital speech patterns to audio output speech wherein:

said transceiver is operable to receive a received compressed code;

said control means is operable to match said received compressed code with a matching receiving unit SCM table entry and to look up a matching receiving unit input stimuli entry comprising a received speech frame which said matching receiving unit SCM table entry is mapped to;

said vocoder processor is operable to receive and convert said received speech frame to a received speech pattern; and said audio output means is operable to convert said received speech pattern to an audio output signal.

7. A communication unit in accordance with claim 6, comprising:

control means which sends said user-specific input stimuli table and said user-specific input stimuli table to said receiving communications unit during a call setup, decodes said input speech frame, matches said decoded input speech frame to a matching input stimuli table entry in said input stimuli table, locates a matching user-specific SCM table entry in said dynamic user-specific SCM table which said matching input stimuli table entry is mapped to, encodes said matching user-specific SCM table entry to a pre-determined compressed code, and sends said compressed code to said transceiver for transmission to a receiving unit;

means for reading a generic speech characteristics model (SCM) comprising a plurality of generic SCM entries, said plurality of generic SCM entries covering a range of different speech characteristics of a plurality of different speakers;

means for accessing a dynamic user-specific speech cavity model (SCM) table comprising a plurality of user-specific SCM table entries each comprising one of said generic SCM entries which model a speech characteristic employed by a user of said communication unit;

means for accessing a user-specific input stimuli table comprising a plurality of input stimuli entries each comprising a speech frame representing a speech pattern employed by said user and each mapping to a user-specific SCM table entry in said dynamic user-specific SCM table;

a transceiver operable to transmit signals to a receiving communications unit and to receive signals from said receiving unit;

speech input means which receives an input speech pattern from said user;

a vocoder processor which converts said input speech pattern to an input speech frame;

control means which sends said user-specific input stimuli table and said user-specific input stimuli table to said receiving communications unit during a call setup, decodes said input speech frame, matches said decoded input speech frame to a matching input stimuli table entry in said input stimuli table, locates a matching user-specific SCM table entry in said dynamic user-specific SCM table which said matching input stimuli table entry is mapped to, encodes said matching user-specific SCM table entry to a pre-determined compressed code, and sends said compressed code to said transceiver for transmission to said receiving unit; and said control means calculating new speech pattern information based on said input speech frame, comparing said new speech pattern information with old speech pattern information, determining if table updates need to be made to said dynamic user-specific SCM table and or said user-specific input stimuli table, updating said dynamic user-specific SCM table and or said user-specific input stimuli table with said table updates and sending said table updates to said transceiver for transmission to said receiving unit for said receiving unit to enter said table updates in its copy of said dynamic user-specific SCM table and or said user-specific input stimuli table if said control means determines that said table updates need to be made.

8. A communication unit in accordance with claim 5, comprising:

user interface means which receives call setup input from said user and generates a call setup command; and wherein said control means is responsive to said call setup command to cause said transceiver to connect to said receiving communications unit and to send said user-specific input stimuli table and said user-specific input stimuli table to said receiving communications unit.

9. A communication unit in accordance with claim 5, comprising:

a memory for storing said dynamic user-specific SCM table and said user-specific input stimuli table.

10. A communication unit in accordance with claim 9, wherein:

said memory stores said generic SCM.

11. A SIM card for a subscriber unit operable for communicating in a telecommunications system, comprising:

a plurality of generic speech characteristics models (SCMs) comprising a plurality of generic SCM entries, said plurality of generic SCM entries covering a range of different speech characteristics of a plurality of different speakers;

a dynamic user-specific speech cavity model (SCM) table comprising a plurality of user-specific SCM table entries each comprising one of said generic SCM entries which model a speech characteristic employed by a user of said subscriber unit; and a user-specific input stimuli table comprising a plurality of input stimuli entries each representing a speech pattern employed by said user and each mapping to a user-specific SCM table entry in said dynamic user-specific SCM table;

wherein said subscriber unit is operable to send said user-specific SCM table and said user-specific input stimuli table to a receiving unit, receive speech patterns input by said user, lookup a matching input stimuli table entry in said input stimuli table, locate a matching user-specific SCM table entry which said matching input stimuli table entry is mapped to, encode said matching user-specific SCM table entry to a compressed code, and send said compressed code to said receiving unit.

12. A SIM card in accordance with claim 11, wherein:

said dynamic user-specific SCM table is sorted according to frequency of occurrence.

13. A SIM card in accordance with claim 12, wherein:

said dynamic user-specific SCM table is sorted using a Huffman compression technique.

14. A SIM card in accordance with claim 12, wherein:

said input stimuli lookup table is sorted according to frequency of occurrence.

15. A SIM card in accordance with claim 14, wherein:

said input stimuli is sorted using a compression technique.

16. A SIM card in accordance with claim 14, wherein:

said input stimuli is sorted using a Huffman compression technique.

* * * * *